United States Patent [19]

Goding et al.

[11] Patent Number: 4,679,506

[45] Date of Patent: Jul. 14, 1987

[54] RAILWAY TRUCK WITH IMPROVED STEERING LINKAGE, DETACHABLE SUSPENSION AND TRACTION MOTOR MOUNTED BRAKE

[75] Inventors: David J. Goding, Palos Park; Remigio R. Ramos, Bolingbrook, both of Ill.

[73] Assignee: General Motors Corporation, Detroit, Mich.

[21] Appl. No.: 800,321

[22] Filed: Nov. 21, 1985

[51] Int. Cl.[4] ..... B61C 9/50; B61F 5/38; B61F 5/30

[52] U.S. Cl. ..... 105/136; 105/166; 105/168; 105/175.1; 105/218.1; 188/33; 188/153 R

[58] Field of Search ..... 105/165–168, 105/175 R, 176, 136, 224 R, 175.1, 224.05, 218, 220; 188/33, 54, 55, 153 R, 153 A, 153 D

[56] References Cited

U.S. PATENT DOCUMENTS

| | | | |
|---|---|---|---|
| 1,138,357 | 5/1915 | Curwen | 105/165 X |
| 2,242,422 | 5/1941 | Eksergian | 105/182 R |
| 2,347,387 | 4/1944 | Aurien | 188/59 |
| 2,373,756 | 4/1945 | Harley et al. | 105/218 R |
| 2,908,233 | 10/1959 | Furrer | 105/168 X |
| 2,925,152 | 2/1960 | Mann et al. | 188/58 |
| 3,394,662 | 7/1968 | Weber | 105/165 |
| 3,835,789 | 9/1974 | Sinclair | 105/224 R |
| 3,841,232 | 10/1974 | Hess | 105/224 R |
| 4,040,361 | 8/1977 | Jackson | 105/136 |
| 4,170,179 | 10/1979 | Vogel | 105/168 |
| 4,173,933 | 11/1979 | Kayserling | 105/182 R |
| 4,202,276 | 5/1980 | Browne et al. | 105/165 |
| 4,285,280 | 8/1981 | Smith | 105/168 |
| 4,498,562 | 2/1985 | Piepenbreier | 188/58 |

FOREIGN PATENT DOCUMENTS

| | | | |
|---|---|---|---|
| 837711 | 5/1952 | Fed. Rep. of Germany | 105/165 |

*Primary Examiner*—Randolph A. Reese
*Attorney, Agent, or Firm*—Robert J. Outland

[57] ABSTRACT

A self-steering railway truck is disclosed having a novel axle relating traction linkage connecting with the bearing housings of a separable suspension system having detachable spring seats shimable for height adjustment. The brake mechanism is mounted on the axle hung traction motors to maintain braking forces within the attached elements and avoid affecting the self-steering action of the wheel and axle assemblies.

15 Claims, 6 Drawing Figures

Figure 1:
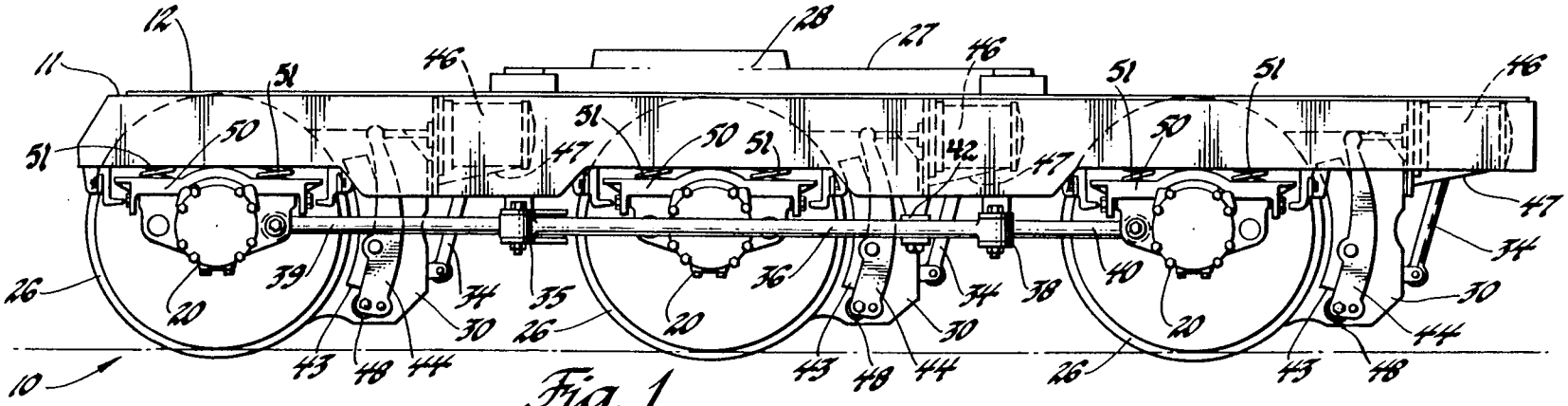

RAILWAY TRUCK WITH IMPROVED STEERING LINKAGE, DETACHABLE SUSPENSION AND TRACTION MOTOR MOUNTED BRAKE

FIELD

This invention relates to railway trucks and, more particularly to suspensions and brake systems for powered railway trucks, especially of a type used for locomotives. In a specific embodiment the invention pertains to a self-steering railway truck having interconnecting steering linkage and suspension and an axle hung traction motor mounted brake system.

BACKGROUND

U.S. patent application Ser. No. 705,330 filed Feb. 25, 1985 now U.S. Pat. No. 4,628,824 and assigned to the assignee of the present invention illustrates a self-steering powered locomotive railway truck arrangement. An illustrated embodiment has a frame supported on wheel and axle assemblies by a primary suspension arrangement utilizing conventional frame attached pedestals which limit the lateral and steering motions of axle mounted journal boxes interconnected by a steering linkage. The axles are individually driven by traction motors supported by the axles and the frame which also carries a brake system having wheel tread engaging shoes, linkage and associated actuating cylinders.

While the application of railway trucks having steerable or self-steering axles has been widely proposed and to some extent applied during recent years, the application of steerable axle concepts to powered locomotive trucks and the like is less far advanced. The use of pedestal guided journal boxes in primary suspensions of nonsteerable axle railway locomotive trucks is common practice. However systems without pedestals are also known as shown for example in U.S. Pat. No. 3,841,232 Hess. In either case, removal of a wheel and axle assembly for replacement or service on an associated traction motor commonly requires raising the truck frame or lowering the axle a substantial distance to extend the primary suspension springs, or the like, to their uncompressed dimension, normally a considerable distance.

In addition, conventional frame mounted brake systems, while operating satisfactorily, must comply with the vertical wheel motions permitted by the primary suspension system. Further, when applied to trucks having steering axles, a brake application will introduce forces tending to return the axles to their centered positions, even though the truck may be undergoing curving action at the time.

INVENTION SUMMARY

The present invention provides a railway truck having a number of features particularly useful in self-steering or steering axle trucks but applicable generally to various other types of railway truck designs. Among these features is a steering beam and lever type linkage for interconnecting the steerable end axles of a multiaxle railway truck to provide interacting steering capabilitity and carry traction and braking forces to the frame. The linkage is connected with journal boxes or bearing adapters, movement of which is guided by the linkage and associated stops, avoiding the need for the usual pedestal construction.

The bearing boxes are attached to separable spring seats having stops interlocking with frame carried elements to limit vertical extension of the suspension springs and permit axle removal by detaching the bearing boxes from the spring seats without fully extending the springs. Shims may be located between the bearing boxes and their spring seats to adjust the truck frame height for wheel wear. In an additional feature, a brake system is provided having actuating means such as shoes and actuating cylinders carried on axle supported traction motor housings which permits the brake mechanism to turn with the axles and avoid introducing turn opposing forces during a brake application.

These and other features and advantages of the invention will be more fully understood from the following description of a selected embodiment taken together with the accompanying drawings.

DRAWINGS

Figure 2:
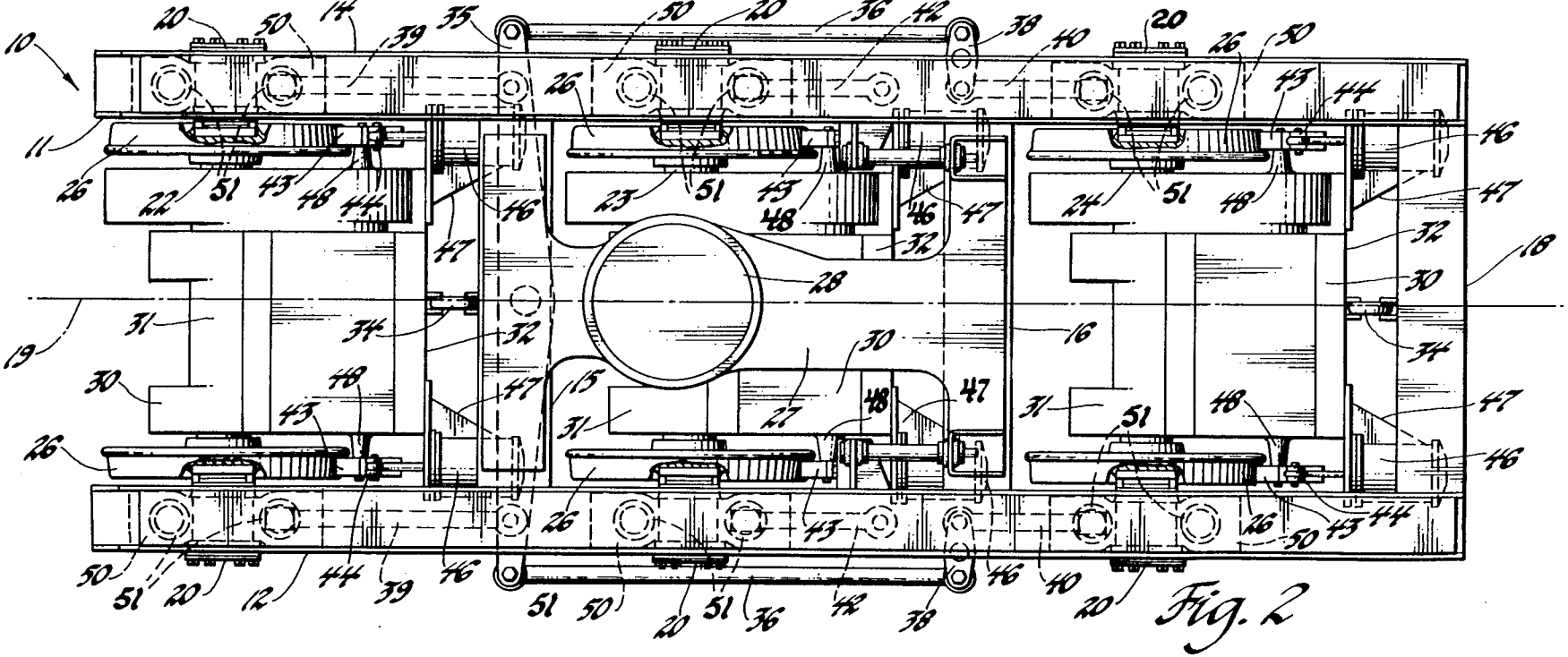
Figure 3:
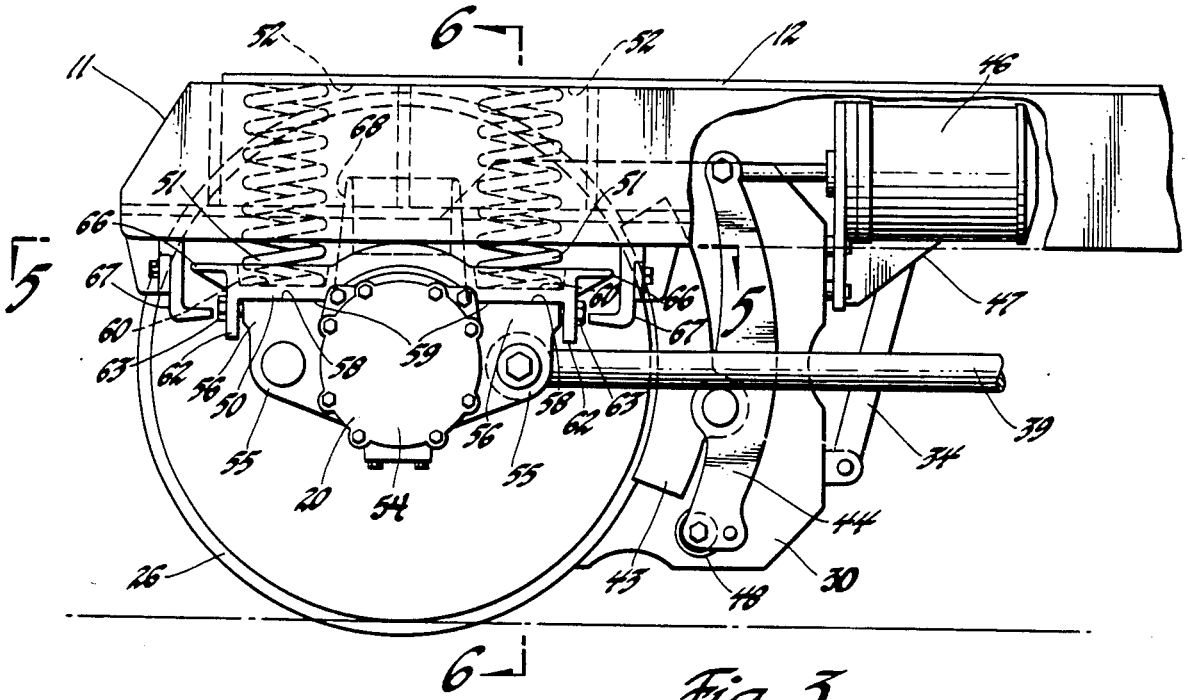
Figure 4:
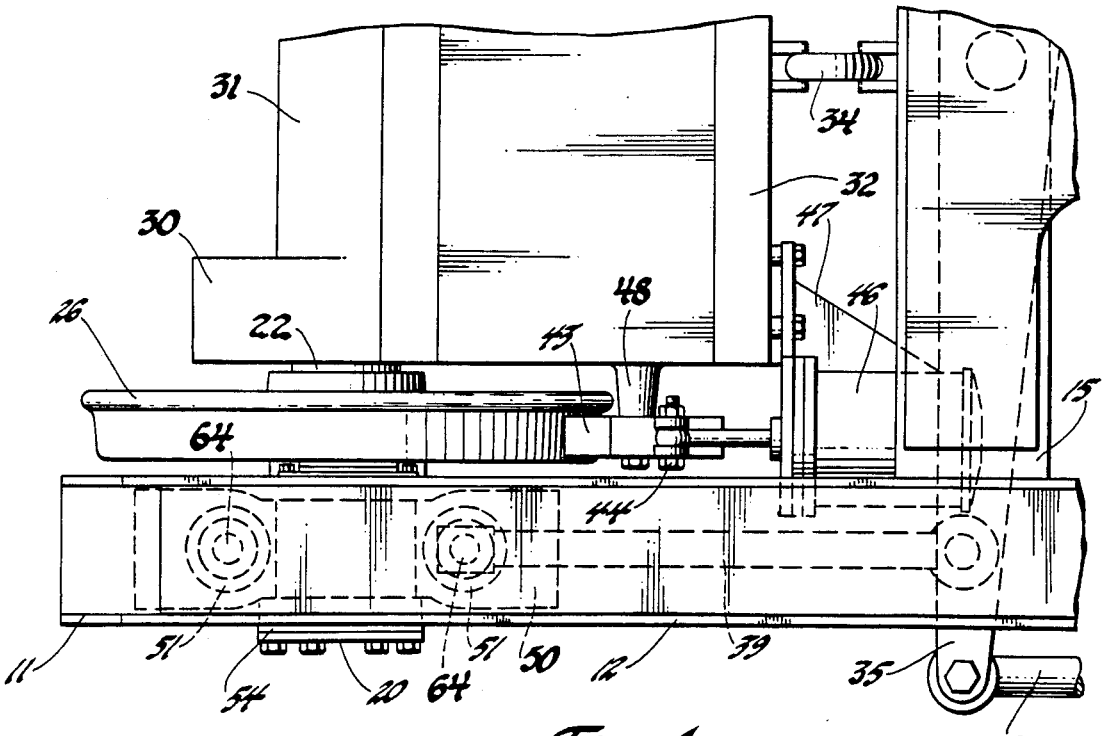
Figure 5:
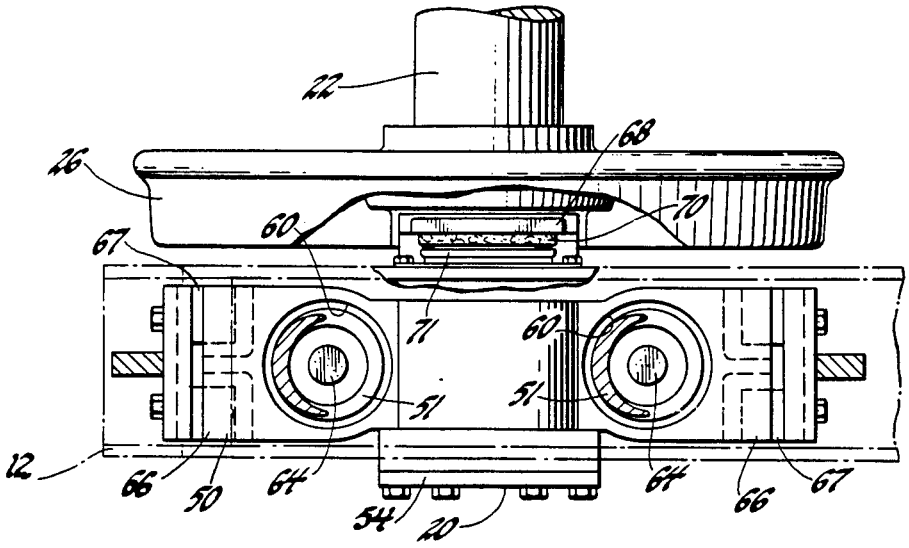
Figure 6:
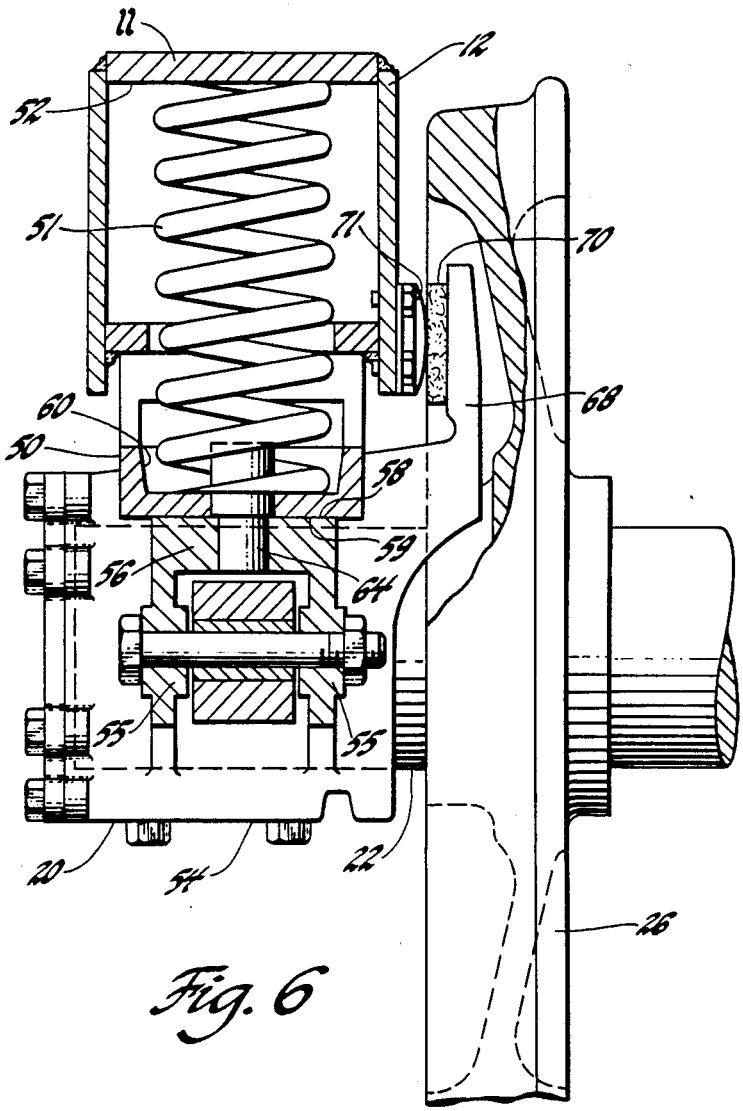

In the drawings:

FIG. 1 is a side view of a three-axle self-steering railway locomotive truck incorporating features in accordance with the invention, FIG. 2 is a top plan view of the truck, FIG. 3 is an enlarged side view of a portion of the truck showing details of the suspension and brake systems, FIG. 4 is an enlarged top view of the portion of the truck shown in FIG. 3, FIG. 5 is a cross-sectional view of the suspension elements from the plane indicated by the line 5—5 of FIG. 3, and FIG. 6 is an enlarged transverse cross-sectional view of the suspension elements from the plane indicated by the line 6—6 of FIG. 3.

DESCRIPTION

In the drawings, numeral 10 generally indicates a powered self-steering three-axle railway truck of the railway locomotive type. The truck 10 includes a unitary frame 11 which is shown as fabricated but may be cast or otherwise manufactured. The frame 11 includes a pair of generally parallel laterally spaced longitudinally extending side frames 12, 14 interconnected by longitudinally spaced transversely extending transoms 15, 16, 18. A central longitudinal vertical plane 19 is located equidistant from the side frames 12, 14.

At longitudinally spaced locations along the side frames, the truck frame is supported by primary suspension means. These include roller bearing adapters, or housings 20, rotatably supported on the ends of front, center and rear axles 22, 23, 24, respectively, carried by rail engagable wheels 26. The wheels 26 are arranged in laterally spaced pairs connected by a single one of the axles 22, 23, 24 to form longitudinally spaced wheel and axle assemblies.

Preferably the longitudinal spacing of the wheel and axle assemblies is equal, as illustrated, and each of the axles is longitudinally spaced an equal distance from a respective one of the transoms 15, 16, 18. The suspension means, to be subsequently further described, allow limited relative motion of the bearing housings 20 relative to the truck frame but resiliently urge the housings 20 and their wheel and axle assemblies into nominally centered noncurving longitudinally aligned positions.

Centrally of the truck, a span bolster 27 is carried on the transoms 15, 16 by suitable secondary suspension means, such as pads or springs, not illustrated. A center bearing 28 or other suitable means is provided on the bolster for pivotably connecting the truck with a carbody, not shown, of a locomotive. If desired, a bolsterless arrangement may be employed wherein the truck frame directly supports the carbody and traction rods transfer longitudinal traction and braking forces therebetween.

For powering the wheel and the axle assembles to drive the locomotive, the truck is provided with three traction motors 30, one for each axle. Each motor has a forward side 31 supported by conventional bearing means on one of the axles and a rearward side 32 carried from one of the adjacent transoms by a depending link 34. The link is flexibly or swively connected at its ends to allow a limited amount of both longitudinal and lateral motion between the traction motor and the adjacent transom member from which it is supported.

To provide for limited self-steering action of the wheel and axle assemblies in accordance with the invention while transmitting traction and braking forces between the wheel and axle assemblies and truck frame, the truck is provided with suitable traction linkage. This linkage includes a lateral steering beam 35 pivotably connected at its center with the truck frame along the bottom of the front transom 15. From the laterally opposite ends of the steering beam, a pair of parallel steering links 36 extend rearwardly to connections with steering levers 38 pivotably mounted on the side frames 12, 14. If desired, suitable stops, not shown, may be provided between elements of the linkage and the frame to limit the extent of the turning or yawing action permitted.

The linkage further includes front traction rods 39 connecting the bearing housings 20 of the front axle with the steering beam at points laterally equally spaced from its pivoted center and rear traction rods 40 connecting the bearing housings 20 of the rear axle 24 with the steering levers 38. In addition, parallel center traction rods 42 are provided which longitudinally connect the bearing housings 20 of the center axle 23 with the underside of the side frames 12, 14.

The steering beam 35, links 36, levers 38 and traction rods 39, 40 are so arranged as to require equal and opposite yawing (steering) motions of the front and rear axle assembles to provide efficient interrelated self-steering actions of the end axles. The center wheel and axle assembly is prevented from yawing relative to the frame by its connection therewith through the traction rods 42. However, lateral motion is permitted by the traction rod connections within limits determined and in a manner to be subsequently described.

The traction rod connections are preferably made by means of rubber bushings, spherical connections or other movable joints to permit relative vertical and lateral motion between the steering beam and its connected bearing housings. The bearing housings preferably include means at both front and rear ends to provide for the connection of traction rods so that identical bearing housings can be utilized at any axle position of the railway truck.

It should be understood that the traction motors 30 are drivingly connected to their respective axles 22, 23, 24 by permanently engaged gears, not shown, which are maintained at a fixed center distance by the mounting of the forward sides 31 of the traction motors on their respective axles through conventional axle bearings, not shown. Because of this mounting arrangement, the traction motors 30 move with their respective wheel and axle assemblies during yawing motions resulting from self-steering action of the front and rear axles.

According to the present invention, this fact is taken advantage of to provide improved braking action for the truck. This is accomplished in the manner best shown in FIGS. 3 and 4 by mounting on each of the traction motors elements of a brake system consisting of a brake shoe 43, an actuating lever 44 and a brake cylinder 46 for each wheel.

As illustrated, each brake cylinder is supported upon a bracket 47 mounted on the rearward side of its respective traction motor. The actuating lever 44 is carried on a support 48 extending from an adjacent end of the traction motor so that the brake shoe 43 is properly aligned with the rail engaging tread of its respective wheel. Obviously, any suitable manner of mounting the cylinder and lever on the traction motor could be utilized depending on the construction of the associated elements.

Further as an optional alternative to the separate cylinder and actuating mechanism herein described, it is presently considered preferable to provide an integrated brake cylinder and actuator device supported by the traction motor housing. Such integrated brake actuator devices are commercially available for locomotive and rail car application, for example from the SAB organizations worldwide represented by the American SAB Company, Inc., Blue Springs, Miss. USA.

As is best shown in FIGS. 3, 5 and 6, the suspension means incorporating the bearing housings 20 further include a spring seat 50 attached to each of the bearing housings and a pair of coil springs 51 extending upwardly from each of the spring seats 50 into pockets 52 in the side frames 12, 14 to resiliently support the side frames on the bearing housings 20.

To provide their required functions, the bearing housings 20 are each provided with a central cylindrical body 54 adapted to receive a roller journal bearing assembly or other suitable bearing means, not shown. Extending longitudinally from either side of the cylindrical body are attaching ears 55 disposed below support portions 56 having longitudinally spaced upwardly facing support surfaces 58. The spring seats 50 include cooperating downwardly facing surfaces 59 which seat upon the support surfaces 58 of the bearing housings. If desired, shims, not shown, may be inserted between surfaces 58, 59 in order to adjust the supported height of the truck frame for wheel wear or spring variation.

The spring seats 50 further include seat pockets 60 for receiving the coil springs 51. Outwardly of the seat pockets, depending tabs 62 of the seats 50 extend outboard of the ends of the bearing housing support portions 56 to which the seats 50 are detachably secured by bolts 63. Guide pins 64 seated in the bearing housings 20 extend upwardly into openings of the spring seats 50 to limit the shear stresses on the bolts 63 by absorbing the forces imposed by lateral and longitudinal motions of the suspension system and its supported truck.

Extension of the coil springs 51 and relative separating motion of the truck frame and associated wheel and axle assemblies is limited by stop means consisting of outwardly extending lips 66 of the spring seat members which engage hooks 67 carried by the truck frame. These stop means also allow a wheel and axle assembly to be removed from the truck frame by removing the bolts 63 and jacking up the truck frame or lowering the wheel and axle assembly until the associated bearing housings 20 are detached from their respective spring seats 50. This may be accomplished while restraining the extension of the coil springs 51 to that permitted by the engagement of the stop means formed by the lips 66 and the hooks 67. Of course, the hooks 67 are also made detachable from the truck frame so that the whole suspension can be lowered to replace the truck springs.

On the inner sides of the bearing housings, upwardly extending arms 68 are provided having outwardly facing wear surfaces which may be defined by thrust pads 70 and extend in opposition to corresponding inwardly facing wear surfaces on the truck frame preferably defined by resilient stops 71. Interaction of the thrust pads 70 with the stops 71, which may be of rubber sandwich construction, provides lateral motion stops which prevent excessive lateral motion of the truck frame on the axles or the axles with respect with the truck frame.

In operation of a railway truck of the type described while mounted under a railway locomotive or the like, the traction motors 30 provide driving torque directly to the axles 22, 23, 24 for turning their respective wheels 26 to move the locomotive in a forward or reverse direction. Changes in track elevation and support of the weight of the railway truck frame and carbody are provided for by the suspension system, including the coil springs 51, which yieldably urge the wheel and axle assemblies into their longitudinally aligned centered positions but allow lateral motion within the limits permitted by the frame stops 71 and bearing housing pads 70.

Self-steering yawing action of the front and rear wheel and axle assemblies is also permitted within the limits permitted by stop means which may be associated with the linkage or by the outer edges of the spring seat lips 66 which engage depending legs of the hooks 67 at the extreme yawing limits. The linkage comprising the steering beam 35, links 36, levers 37 and traction rods 39 and 40 interrelate the yawing motions of the front and rear wheel and axle assemblies to movements of equal magnitude and opposite direction thereby providing efficient self-steering action with resulting low rail friction during curving action of the truck.

Upon application of the brakes, the brake cylinders 46 act upon the actuating levers 44 to urge the brake shoes 43 against the tread surfaces of their respective wheels with substantial braking forces. These forces do not however affect the self-steering action of the truck axles since the brake elements are all mounted upon the traction motors and the reaction forces are taken by the traction motor axle bearings.

When it is desired to remove or lower a wheel and axle assembly for service, this may be done without fully extending the coil springs 51 because of the limiting action of the lips 66 and hooks 67 which stop the motion of the spring seats. The bearing housings may then be detached from the spring seats and the wheel and axle assembly removed from the truck. In a similar manner, a wheel and axle assembly may be lowered only enough to insert shims between the surfaces 58, 59 of the housings and spring seats to adjust the height of the truck frame for wheel wear.

It should be noted that the use of the terms front, rear, forward, rearward and the like in describing the various elements and directions relating to the illustrated embodiment of a railway truck are for descriptive purposes only and are not intended to limit the application of the railway truck in a locomotive or the like to any particular direction of operation since operation in either direction may be equally acceptable. Further it should be noted that the various features of the invention which have been illustrated in the described railway truck embodiment are not necessarily limited to application in mechanisms of the type described. Accordingly, the invention and its various features should not be limited to the described embodiment but should have the full scope permitted by the language of the following claims.

The embodiments of the invention in which an exclusive property or privilege is claimed are defined as follows:

1. A combination in a self-steering railway truck of a pair of longitudinally spaced rail engaging wheel and axle members each including a pair of wheels laterally connected by an axle, frame means having a central longitudinal and vertical plane and carried by said axles, yieldable suspension means supporting the frame on the axles and nominally urging said wheel and axle members into centered positions for motion along straight paths aligned with said central plane but permitting limited self-induced yawing of said members during movement along curved paths, and force transmitting linkage connecting said wheel and axle members with the frame, said linkage including a lateral steering beam and two pairs of connecting rods, said steering beam having a center pivotally connected with said frame in said central plane and being free of any connection with an associated carbody except through said frame, and the connecting rods of each of said pair nominally extending longitudinally on opposite sides of and parallel with said central plane and pivotally connecting laterally opposite points of an associated wheel and axle assembly with points opposite from one another on the steering beam and equidistant from its center, one of said connecting rod pairs directly connecting its wheel and axle member with the steering beam and the other of said connecting rod pairs connecting indirectly through direction reversing lever means its wheel and axle member with the steering beam to require self-steering yaw motions of said wheel and axle members to be of opposite sense and substantially equal extent and to carry longitudinal forces from the wheels to the truck frame without causing significant yaw forces in the wheel and axle members.

2. A combination as in claim 1 wherein said suspension means includes a pair of bearing containing housings supported by each axle at laterally spaced locations on opposite sides of said plane and support means between each of said bearing housings and the frame, each of said support means including a resilient member supporting the frame and supported by a seat detachably fixed to its respective bearing housing, said combination further including vertical stop means on the frame and each of said seats and engagable to limit extension of the resilient members and the downward movement of the seats relative to the frame, thereby providing for lifting of the wheel and axle members along with the truck frame but allowing separation of the bearing housings from their respective seats and lifting of the frame and the support means without raising the wheel and axle members.

3. A combination as in claim 2 and further including lateral stop means on the frame and on one of the seat and bearing housing members included in each suspension means to limit lateral motion of the associated wheel and axle members relative to the frame.

4. A combination in a railway truck of a pair of longitudinally spaced rail engaging wheel and axle members each including a pair of wheels laterally connected by an axle, frame means having a central longitudinal and vertical plane and carried by said axles, suspension means supporting the frame on the axles, said suspension means including a pair of bearing containing housings supported by each axle at laterally spaced locations on opposite sides of said plane and support means between each of said bearing housings and the frame, each of said support means including a resilient member supporting the frame and supported by a seat detachably fixed to its respective bearing housing, force transmitting linkage longitudinally connected between the frame and one of the seat and bearing housing members included in each suspension means to transmit traction and braking forces between the wheel and axle members and the frame, lateral stop means on the frame and on one of the seat and bearing housing members included in each suspension means to limit lateral motion of the associated wheel and axle members relative to the frame, and vertical stop means on the frame and each of said seats and engagable to limit extension of the resilient members and the downward movement of the seats relative to the frame, thereby providing for lifting of the wheel and axle members along with the truck frame but allowing separation of the bearing housings from their respective seats and lifting of the frame and the support means without raising the wheel and axle members.

5. A combination as in claim 4 wherein said seats and their associated bearing housings are connected along opposed generally horizontal surfaces between which shims may be installed to adjust the height of the frame above the rails.

6. A combination in a self-steering railway truck of:

a pair of longitudinally spaced rail engaging wheel and axle members each including a pair of wheels laterally connected by an axle;

frame means having a central longitudinal and vertical plane and carried by said axles;

suspension means supporting the frame on the axles and nominally urging said wheel and axle members into centered positions for motion along straight paths aligned with said central plane but permitting limited self-induced yawing of said members during movement along curved paths, said suspension means including a pair of bearing containing housings supported by each axle at laterally spaced locations on opposite sides of said plane and support means between each of said bearing housings and the frame, each of said support means including a resilient member supporting the frame and supported by a seat detachably fixed to its respective bearing housing;

force transmitting linkage longitudinally connected between the frame and one of the seat and bearing housing members included in each support means to transmit traction and braking forces between the wheel and axle members and the frame while interconnecting the axles to relate the self-steering action thereof;

lateral stop means on the frame and one of the seat and bearing housing members included in each support means to limit lateral motion of the associated wheel and axle members relative to the frame; and vertical stop means on the frame and each of said seats and engagable to limit extension of the resilient members and the downward movement of the seats relative to the frame, thereby providing for lifting of the wheel and axle members along with the truck frame but allowing separation of the bearing housings from their respective seats and lifting of the frame and the support means without raising the wheel and axle members.

7. Suspension means for use between the frame and an axle of a railway truck, said suspension means comprising a bearing containing housing adapted to be supported by the axle, a seat detachably fixed to the bearing housing, a resilient member adapted to support the frame and supported by the seat, connection means on one of the seat and bearing housing members for connecting a longitudinal force transmitting link to said one member for transmitting traction and braking forces between the axle and the frame, lateral stop means on one of the seat and bearing housing members for engaging corresponding means on the frame to limit lateral motion of the axle relative to the frame, and vertical stop means on said seat and engagable with corresponding means on the frame to limit extension of the resilient member and the downward movement of the seat relative to the frame, thereby providing for lifting of the axle along with the truck frame but allowing separation of the bearing housing from the seat and lifting of the frame and the support means without raising the axle.

8. A combination as in claim 7 wherein said seat and said bearing housing are connected along opposed generally horizontal surfaces between which shims may be installed to adjust the height of the frame above the rails.

9. A bearing housing and spring seat assembly for use in a railway truck having a frame and a wheel supported axle, said assembly comprising a bearing housing having a body with a central axle bearing receiving portion and an upwardly facing support surface, and a seat member mounted above the housing and having a lower surface carried on the housing support surface, restraining means acting between said housing and seat members to restrain relative horizontal motion therebetween but allow limited vertical displacement of the seat member above the bearing housing such as by the insertion of shims between said surfaces, and connecting means acting between said housing and seat members when tightened to retain them in fixed vertical relation, said connecting means being releasable to permit disassembly of said members and to permit adjustment of the spacing of said members such as by shimming between said surfaces.

10. An assembly as in claim 9 wherein one of said housing and seat members further includes means for connection with traction linkage for carrying traction and braking forces between the assembly and the frame.

11. An assembly as in claim 9 wherein said bearing housing further includes connection means on the body spaced longitudinally adjacent the bearing receiving portion for connecting the housing with traction linkage and stop means on the body at one end of the bearing receiving portion for engaging a cooperating frame carried element to limit lateral motion thereof.

12. A combination in a powered steering railway truck of a pair of longitudinally spaced rail engaging wheel and axle members each including a pair of wheels laterally connected by an axle, frame means carried by said axles, yieldable suspension means supporting the frame on the axles and permitting limited yawing of said wheel and axle members, a traction motor drivingly connected with at least one of said axles, said motor having a housing supported along one side by axle bearings carried by its respective axle and restrained from rotation about said axle by torque means reacting against said frame, said motor housing moving together with said axle during yawing of the wheel and axle members, and a tread brake including a wheel engagable shoe and actuating means including a force developing device connected with and operative to move said shoe into and out of engagement with said wheel to apply and release the brake, said actuating means being carried on said traction motor housing to establish fixed dimensional relations between the brake and its associated wheel and to completely separate the brake application forces from having any effect upon the axle steering forces.

13. A combination in a powered self-steering railway truck of a pair of longitudinally spaced rail engaging wheel and axle members each including a pair of wheels laterally connected by an axle, frame means having a central longitudinal and vertical plane and carried by said axles, yieldable suspension means supporting the frame on the axles and nominally urging said wheel and axle members into centered positions for motion along straight paths aligned with said central plane but permitting limited self-induced yawing of said members during movement along curved paths, force transmitting linkage connecting said wheel and axle members with the frame, said linkage including a lateral steering beam and two pairs of connecting rods, said steering beam having a center pivotally connected with said frame in said central plane and being free of any connection with an associated carbody except through said frame, and the connecting rods of each said pair nominally extending longitudinally on opposite sides of and parallel with said central plane and pivotally connecting laterally opposite points of an associated wheel and axle assembly with points opposite from one another on the steering beam and equidistant from its center, one of said connecting rod pairs directly connecting its wheel and axle member with the steering beam and the other of said connecting rod pairs connecting indirectly through direction reversing lever means its wheel and axle member with the steering beam to require self-steering yaw motions of said wheel and axle members to be of opposite sense and substantially equal extent and to carry longitudinal forces from the wheels to the truck frame without causing significant yaw forces in the wheel and axle members, a traction motor drivingly connected with at least one of said axles, said motor having a housing supported along one side by axle bearings carried by its respective axle and restrained from rotation about said axle by torque means reacting against said frame, said motor housing moving together with said axle during yawing of the wheel and axle members, and a tread brake including a wheel engagable shoe and actuating means including a force developing device connected with and operative to move said shoe into and out of engagement with said wheel to apply and release the brake, said actuating means being carried on said traction motor housing to establish fixed dimensional relations between the brake and its associated wheel and to completely separate the brake application forces from having any effect upon the axle steering forces.

14. A combination as in claim 13 wherein said suspension means includes a pair of bearing containing housings supported by each axle at laterally spaced locations on opposite sides of said plane and support means between each of said bearing housings and the frame, each of said support means including a resilient member supporting the frame and supported by a seat detachably fixed to its respective bearing housing, said combination further including vertical stop means on the frame and each of said seats and engagable to limit extension of the resilient members and the downward movement of the seats relative to the frame, thereby providing for lifting of the wheel and axle members along with the truck frame but allowing separation of the bearing housings from their respective seats and lifting of the frame and the support means without raising the wheel and axle members.

15. A combination as in claim 14 and further including lateral stop means on the frame and one of each of the associated seat and bearing housing members to limit lateral motion of the associated wheel and axle members relative to the frame.

* * * * *